US006183402B1

(12) United States Patent
Pedersen et al.

(10) Patent No.: US 6,183,402 B1
(45) Date of Patent: Feb. 6, 2001

(54) SELF-POSITIONING VAGINAL WEIGHT WITH FACILITATION

(75) Inventors: Jan Bredgaard Pedersen, Aarhus; Lise Ebdrup, Roende, both of (DK); Jens Axelgaard, Fallbrook, CA (US)

(73) Assignee: Inmedico ApS, Egaa (DK)

( * ) Notice: Under 35 U.S.C. 154(b), the term of this patent shall be extended for 0 days.

(21) Appl. No.: 09/404,107

(22) Filed: Sep. 23, 1999

Related U.S. Application Data

(63) Continuation-in-part of application No. PCT/DK98/00169, filed on Apr. 29, 1998.

(51) Int. Cl.[7] ..... A63D 23/20
(52) U.S. Cl. ..... 482/105; 482/93
(58) Field of Search ..... 482/92, 93, 105, 482/148

(56) References Cited

U.S. PATENT DOCUMENTS 5,213,557 * 5/1993 Firth ..... 482/105
5,554,092 * 9/1996 Harpstead et al. ..... 482/148

* cited by examiner

*Primary Examiner*—John Mulcahy
(74) *Attorney, Agent, or Firm*—Walter A. Hackler

(57) ABSTRACT

A vaginal weight is provided which includes a tubular portion with a rounded end for enabling smooth insertion into a vagina. Another flat end and/or roughened surface disposed on the tubular portion enables user sensed vaginal resistance during outward movement of the weight in order to cause enhanced facilitation. A method utilizing the weights of the invention provides for exercising and examining the striated musculature.

19 Claims, 5 Drawing Sheets

FIG. 16.
(PRIOR ART)
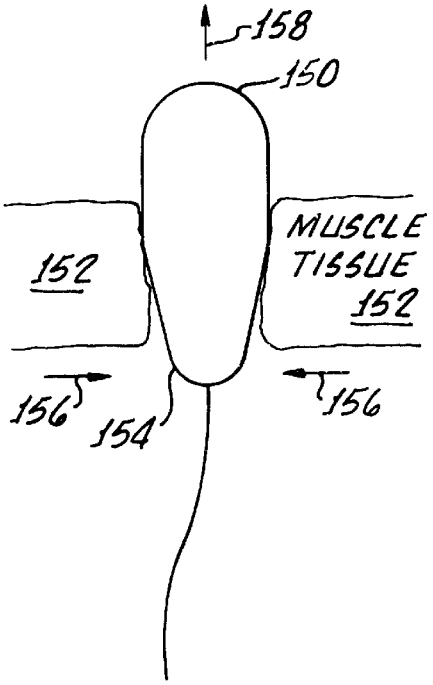
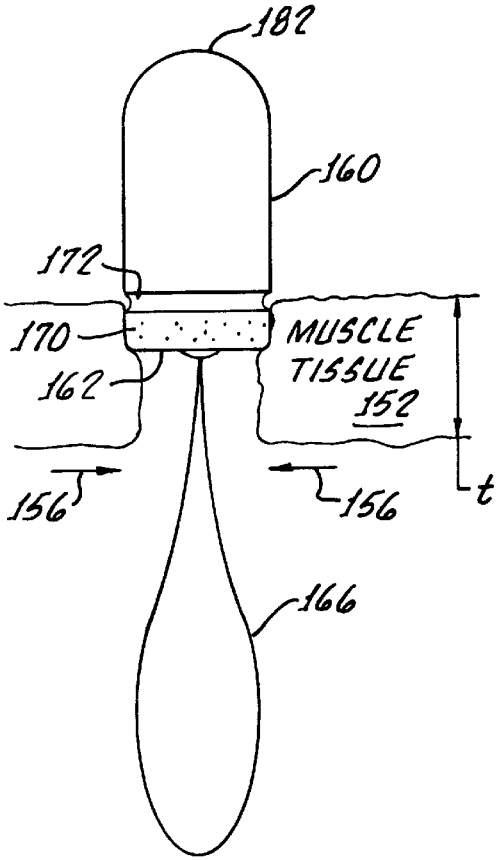
FIG. 17.
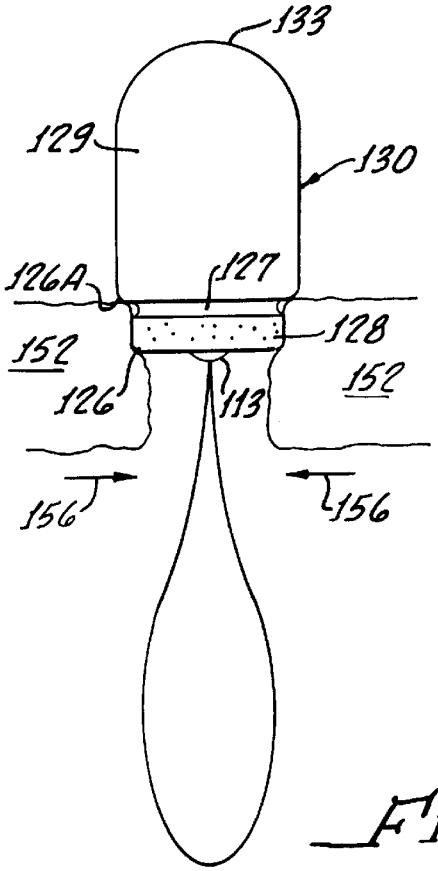
FIG. 18.

SELF-POSITIONING VAGINAL WEIGHT WITH FACILITATION

The present application is a continuation-in-part of International Patent Application Ser. No. PCT/DK98/00169 filed Apr. 29, 1998, and designating U.S.A. This application is to be incorporated in its entirety including specification and drawings into the present application by this specific reference thereto.

The present invention generally relates to strengthening of pelvic floor muscles and more particularly relates to a vaginal weight, a set of vaginal weights and a method of treating incontinence.

Exercising of the striated muscles of the pelvic floor has been used to prevent and treat problems of incontinence for decades. A too slack and weak pelvic floor musculature frequently results in a state of incontinence (involuntary loss of urine and/or faeces). The causes have many different explanations, however, at least three parameters appear to influence the state: the striated musculature with its fascia and ligamentous tissue, the smooth musculature and the vascularization.

Ultrasonic scannings have demonstrated significant differences in the position of the neck of bladder in the pelvic cavity between continent and incontinent women, which means in practice that the urethral pressure for incontinent women will frequently be lower than the bladder pressure, and that the pressure transformation to the urethra, at a pressure increase in the abdomen, will be poorer and, therefore, leakage can easily occur.

It has moreover been demonstrated that when particularly the levator ani is affected, the pressure increases in the urethra, in particular mid-urethral, and the position of the neck of the bladder is moved anterior cranially toward the os pubis.

The above mentioned pressure increase in the urethra may be generated voluntarily by means of Kegel (squeezing) exercises.

The teaching of Kegel exercises, however, have involved many problems, since correct use of the deep pelvic floor musculature is difficult because of the position of the muscles. When being taught correct muscular use elsewhere in the body, one can frequently move the muscle via a joint while using so-called facilitation techniques which help the learning.

Under the law of facilitation, when an impulse has passed once through a certain set of neurons to the exclusion of others, it will tend to take the same course on a future occasion, and each time it traverses this path, the resistance in the path will be smaller. Thus, according to this principle, muscle use can be taught.

Moreover, continued Kegel exercising has the effect of increasing pelvic floor muscle bulk. In healthy women, the thickness of the hammock-shaped levator ani muscle is about 1 cm in the sagittal plane. In women having weak pelvic floor muscles and/or problems of incontinence, the muscles have become very thin in many cases.

Assessment of the strength of the pelvic floor in order to evaluate the result of the treatment also involves some problems. Influence from the pressure in the abdomen and use of synergists for the pelvic floor musculature are difficult to exclude when using e.g. various forms of biofeedback. It has been attempted to standardize vaginal palpation performed by a physiotherapist, but, naturally, a subjective measuring method has its limitations with respect to use and reproducibility.

Further, biofeedback and vaginal palpation as an examination method have been performed by most people exclusively in a supine position, which corresponds poorly with the fact that only in a standing position does the pelvic floor exhibit its functional strength and endurance.

With these problems in view, so-called vaginal weights have been used for some years as a supplement to examination as well as exercising. Good results have been obtained, and the method is easy to understand and use by the patient. However, there have been some problems in connection with the use of vaginal weights, as the anatomical conditions vaginally vary much from patient to patient, just as the anatomical conditions vary depending on the cause of the problem of incontinence.

The principle of using vaginal weights for exercising is to facilitate the muscular tissue for contraction via sensory input from the contact of the weight with the muscular tissue. This requires that the weight has a shape and a size which enable contact with the tissue. Studies have shown, however, that up to 17% of a group of women could not use common vaginal weights because the size of the levator gap made tissue contact impossible.

Measurement of endurance and strength by means of vaginal weights requires a reasonably differentiated weight distribution, and there are weights where diameter and weight "fit together", i.e., have a certain mutual size ratio. Existing vaginal weights, however, have the drawback that the weights are dimensioned so that diameter and weight are proportional, which means that larger diameter results in greater weight. This, however, is extremely inexpedient. Physiologically, however, inverse proportionality is required because the use of the largest weight takes place in the case where the levator gap of the woman is so wide that other diameters merely slip out. Thus the problem is that a wide levator gap generally is a symptom of weak muscles, for which reason the patient cannot retain the weight.

A further drawback of certain known vaginal weights is the geometrical shape of the weight, as several of these have a conical shape at one or both ends, which may mean that the weight, after insertion and during contraction of the musculature, slides further up into the vagina and tilts so that its position becomes horizontal, and consequently is placed so high that the exercise has no effect.

A further drawback of the known vaginal weights is that, under certain conditions, they may be extremely difficult to position in the vagina, particularly if the user has a backwardly bent vagina which, in the standing position, in combination with the bend already possessed by the vagina, causes a shelf to be formed on which the weight can lie without the musculature being used.

U.S. Pat No. 5,407,412 and EP 0,392,854 both describe vaginal weights. The vaginal weights described in these documents have a conical shape at the end pointing towards the opening of the vagina. Thus the vaginal weight, after insertion and during contraction of the musculature, might slide further up into the vagina and tilt so that the position is horizontal, and consequently be disposed so high that the exercise has no effect. Another problem with the conical shape is that the vaginal weight might slide out of the vagina.

SUMMARY OF THE INVENTION

The vaginal weight in accordance with the present invention for insertion into a vagina for exercising and examining striated musculature generally includes a tubular portion with rounded end means disposed at one end of the tubular portion for enabling smooth insertion into the vagina. In combination therewith, means disposed at another end of the tubular portion are provided for enabling a user sensed vaginal resistance during outward movement of the weight from the vagina.

More particularly, in accordance with the present invention, the means disposed at another end of the tubular portion comprises a flat end surface disposed at a generally perpendicular angle with the tubular portion longitudinal axis. The flat end surface is joined with an outside surface with the tubular portion by a rounded corner.

In addition, the means disposed at another end of the tubular portion may comprise a rough surface disposed on the tubular portion outside surface.

The vaginal weight in accordance with the present invention may further include means for positioning the weight in the vagina for enhanced facilitation. This last mentioned means may be a string attached to the another end of the tubular portion.

The means for positioning the vaginal weight in accordance with the present invention may further comprise a mass disposed within the weight at a position causing a center gravity of the weight to be closer to the another end than the one end of the tubular portion.

In addition, the rough surface hereinabove noted may include an assembly of discrete optionally exchangeable embossings projecting from the tubular portion outside surface.

Further, the tubular portion may include an upper part adjacent the rounded end means and a lower part adjacent the another end with the upper part having a larger diameter than the lower part.

A vaginal weight system is provided in accordance with the present invention which includes a plurality of the weights hereinabove described.

Importantly, in this system, the heaviness of each weight is inversely proportional to the diameter of each weight, the advantages being hereinafter discussed.

The weights in accordance with the present invention also enable a method for exercising and examining the striated musculature. Briefly, the method includes inserting a weight in accordance with the present invention into a user's vagina with the rounded end means first. The weight is then pulled until a vaginal resistance is sensed by the user in order to position the weight in the user's vagina to effect facilitation. Positioning of the weight is enabled by the string attached to the another end of the tubular portion. When in a standing position, positioning of the weight is also aided by the effects of gravity.

Thereafter, the weight is held in the facilitation position without user movement for a first period of time by squeezing pelvic floor muscles. The weight is thereafter removed.

The method further comprises the step of the user resting for a second duration of time with the weight removed. Thereafter, the steps of inserting the weight and holding the weight are repeated.

BRIEF DESCRIPTION OF THE DRAWINGS

The advantages and features of the present invention will be better understood by the following description when considered in conjunction with the accompanying drawings, in which:

FIG. 16 illustrates a prior art device in relation to muscle tissue and its disadvantage;

FIG. 17 illustrates a device in accordance with the present invention and its relation to muscle tissue;

FIG. 18 illustrates an alternative embodiment in accordance with the present invention and its relation to muscle tissue.

DETAILED DESCRIPTION

Figure 1:
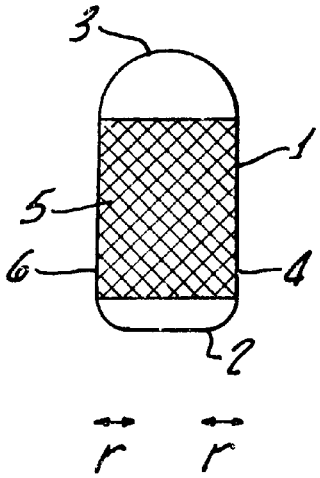
FIG. 1 shows a lateral view of a vaginal weight according to the present invention.

FIG. 1 shows a lateral view of a preferred embodiment of the invention, where a vaginal weight 1 comprises a lower termination 2 and an upper termination 3.

The vaginal weight 1 additionally comprises a rough surface 6 which is formed by a plurality of grooves 5.

The grooves 5 are formed with a very small depth, just as the grooves are suitably rounded so that they do not irritate or strain touching mucosae.

The lower termination 2 of the vaginal weight 1 is also formed with a relatively distinct edge having a small radius of curvature r, which endures that the vaginal weight 1 in use maintains the intended position in the vagina.

The upper termination 3 is suitably rounded so that insertion of the weight into the vagina poses no problems.

The weight 1 is additionally provided with an anchorage for a string or the like (not shown in the embodiment of FIG. 1) which may be used when the weight 1 is to be retrieved from its position of use.

According to the invention, the weight shown may, e.g., be part of a set of weights comprising a plurality of the weights mentioned below, where the upper row indicates the total diameter of the vaginal weight, while the lower row indicates the total mass and possible tolerance of the vaginal weight.

| mm | 32 | 30 | 28 | 26 | 26 | 25 | 25 | 24 |
|---|---|---|---|---|---|---|---|---|
| g +20% | 10 | 20 | 30 | 30 | 40 | 40 | 50 | 60 |

It will be appreciated, according to the invention, that it is possible to construct the contact area 6 formed by the grooves 5 with other types of roughness elements, such as embossings, small knobs, depressions or the like.

It will likewise be appreciated that the roughness area 6 may cover the entire surface of the vaginal weight or parts of it, if this is advantageous, in a specific desired facilitation profile.

Figure 2:
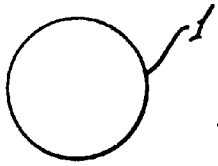
FIG. 2 shows the vaginal weight shown in FIG. 1 from above.

FIG. 2 is a top view of the vaginal weight shown in FIG. 1, it being noted that the weight is rotationally symmetrical.

Figure 3:
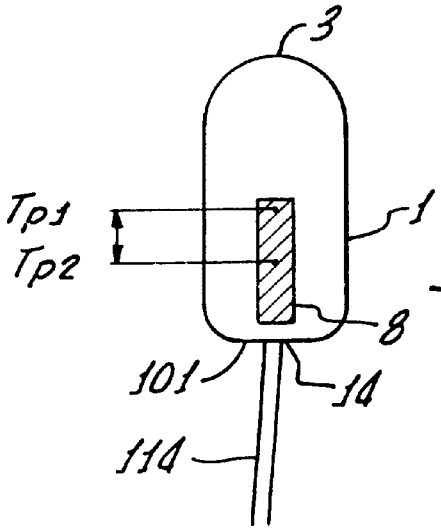
FIG. 3 shows a cross section of the vaginal weight shown in FIG. 1.

FIG. 3 shows a cross section of the vaginal weight 1 shown in FIG. 1, it being visible that the weight comprises a weight member 8.

The weight member 8 is so positioned in the weight 1 that the center of gravity Tp2 of the weight member is considerably below the center of gravity Tp1 of the vaginal weight.

The weight is additionally mounted by a string 114 at an anchorage point 14, e.g., by embedding.

The string 114, which is used for retrieving the weight 1 in the vagina, will be discussed hereinafter in greater detail. This is particularly important in connection with the invention, as the special shape of the lower termination of the weight 1 also constitutes an important facilitation surface when pulling the string 114. In addition, the string 114 ensures in a natural and simple manner that the weight member is inserted with the upper termination uppermost, thereby achieving correct use of the weight 1.

The weight 1 also has a substantially plane lower termination.

According to the present embodiment, the weight 1 itself may be made of PPO, which is frequently used for injection molding of medical devices. An alternative material may, e.g., be polyethylene.

The weight members 8 used will preferably be made of stainless steel.

Figure 4:
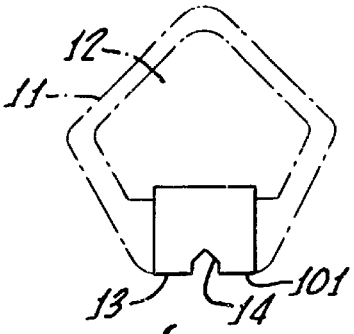
FIG. 4 shows a further embodiment of the invention.

FIG. 4 shows a cross section of a further embodiment of the invention.

As will appear from FIG. 4, the vaginal weight shown comprises a shell 11 which forms the upper part of a vaginal weight. The shell 11 may be made of PPO or polyethylene. The shell forms a cavity 12 which is closed by a weight member 13 at its lower termination. The weight member 13 is made of stainless steel e.g. According to the invention, the weight member may, e.g., be snapped, glued or screwed on as a bayonet socket.

An advantage of the invention is furthermore that the weight member forms part of the total surface of the vaginal weight and may be inserted separately, thereby making it possible to obtain a maximum lowering of the center of gravity, and also possible to exchange or adjust the weight according to the use. It is thus possible to change a given weight, just as it is possible to adjust the associated center of gravity.

The weight member 13 additionally has an anchorage 14 which may be used for securing a string (not shown in FIG. 4) or the like for retrieving the weight from its position of use.

Figure 5:
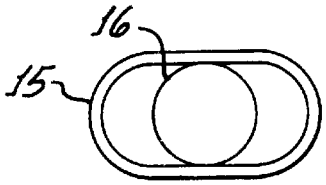
FIG. 5 shows a cross section of the vaginal weight shown in FIG. 4.

FIG. 5 shows a cross section of the embodiment of the invention shown in FIG. 4, illustrating the specific asymmetrical shape of the shell 15 with respect to the position of the weight member 16 in the weight.

Alternative embodiments may include making the vaginal weight itself or its shell of a resilient material.

With respect to the so-called rough surface used according to the invention, this may be made as an adaptive surface relative to the moisture of the environment of use. For example, for such purposes, it is possible to use exchangeable fibre materials which may be fixed to and removed from the surface of the vaginal weight in a suitable manner.

The rough surface in the form of bosses, grooves or similar embossings or projections may be made by knurling, and it may also be made during the actual injection molding of the vaginal weight or its shell by texturing.

It will likewise be appreciated that it is possible to give the vaginal weights suitable anatomical shapes, such as symmetrical or asymmetrical ones, which is moreover more attractive since, as is the case according to the invention, the positioning and the directional orientation of the vaginal weight in use become more distinct.

Figure 6:
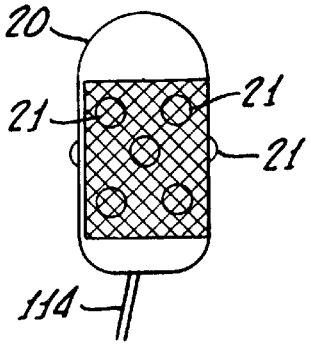
FIGS. 6–11 show lateral views of further embodiments of the present invention.

A further example of such an embodiment of the invention is shown in FIG. 6, in which a vaginal weight 20 is formed with a rough surface corresponding to the one shown in FIG. 1, a plurality of knobs 21 being superimposed on the groove pattern, thereby providing two types of facilitation faces, a macroscopic facilitation face consisting of the knobs 21 and a microscopic facilitation face consisting of the grooves.

Figure 7:
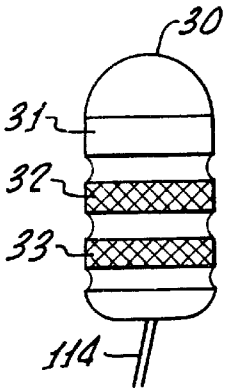

FIG. 7 shows a further embodiment of the invention. A vaginal weight 30 is here formed with macroscopic facilitation faces 31, 32 and 33, which each comprise a microscopic rough surface respectively consisting of a studded rough surface 31 and grooved rough surfaces 32 and 33. Two types of facilitation faces are achieved, a macroscopic facilitation face and a microscopic facilitation face, on the same vaginal weight.

Figure 8:
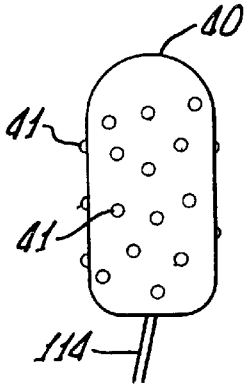

FIG. 8 shows a further embodiment according to the invention. A vaginal weight 40 is formed with macroscopic facilitation faces 41 in the form of knobs, which each are formed with a microscopic facilitation face in the form of a rough surface which consists of a studded rough surface 31.

As a variant of this, the knobs themselves may be smooth, while the rest of the weight may have a microscopic facilitation face.

Figure 9:
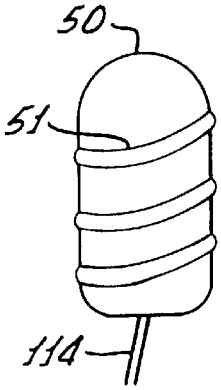

FIG. 9 shows a further embodiment of the invention. A vaginal weight 50 is formed with a macroscopic facilitation face in the form of a twisted band 51. The band may also be formed with a microscopic facilitation face in the form of a rough surface, which consists of a studded rough surface.

As a variant of this, the band 51 itself may be smooth, while the rest of the weight may have a microscopic facilitation face.

Figure 10:
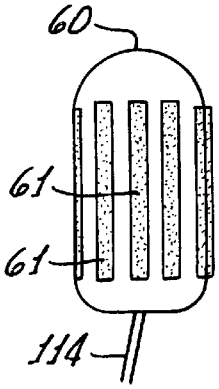

FIG. 10 shows a further embodiment of the invention. A vaginal weight 60 is formed with a macroscopic facilitation face in the form of longitudinal bands 61. The bands may also be formed with a microscopic facilitation face in the form of a rough surface, which consists of a studded rough surface.

As a variant of this, the band 61 itself may be smooth, while the rest of the weight may have a microscopic facilitation face.

Figure 11:
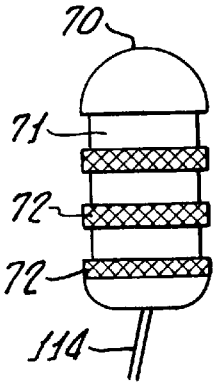

FIG. 11 shows a further embodiment according to the invention. A vaginal weight 70 is formed with a macroscopic facilitation face in the form of depressions 71 and a annular band 72. As shown, the bands may also be formed with a microscopic facilitation face in the form of a rough surface, which consists of a grooved surface.

The individual rough surfaces in the above figures may be exchangeable in the form of rubber bands or faces which may be snapped on, and the facilitation surfaces may moreover be embedded.

Figure 12:
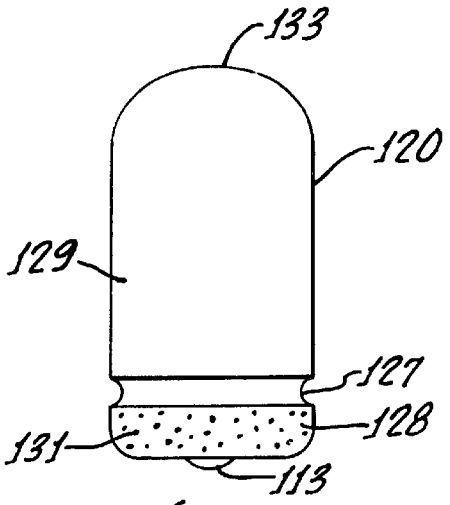
FIG. 12 shows a preferred embodiment of the invention.
Figure 13:
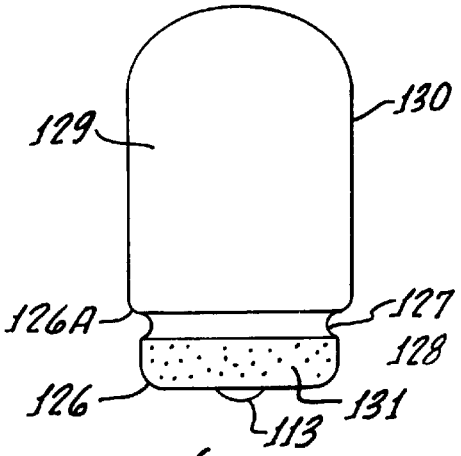
FIG. 13 shows the preferred embodiment of a vaginal weight according to the invention.

FIGS. 12, 13 and 18 show a lateral view of preferred embodiments of the invention, in which the vaginal weight 130 has a lower base part 128 and an upper top part 129 . At the bottom the base part 128 is provided with anchoring means 113 for securing the string 114, which may be used partly for exercising purposes partly for retrieving the weight 130 from the vagina. It is moreover formed with embossings 131 in a relatively coarse structure.

At the top, the upper part 129 is terminated with a rounding 133 so that the insertion of the weight into the vagina may be performed without any problems. The side face and the rounding 133 are formed with a fine-structured facilitation surface.

The top and base parts are separated by a ring-shaped depression 127. Additionally, when the straight upper portion, or 129, from the lower edge of the upper part to the start of the rounding 133 is of varying length, the muscular grip is maximized by matching the length of the neck 129 to a thickness, t, of the pelvic floor musculature, thus accommodating varying degrees of muscular atrophy. (See FIG. 17 for illustrating the thickness, t,).

FIGS. 13 and 18 show a more preferred structure in which the top part 129 is formed with a larger diameter than the base part 128.

The lower termination 126 of the vaginal weight is also formed with a relatively distinct edge having a relatively small radius of curvature, which ensures that the vaginal weight in use maintains the intended position in the vagina. The lower termination of the upper part, immediately above the depression 127, is formed with a corresponding termination 126A having a different preferably smaller radius of curvature. Alternatively, the two terminations 126, 126A may be formed with the same radius of curvature.

Figure 14:
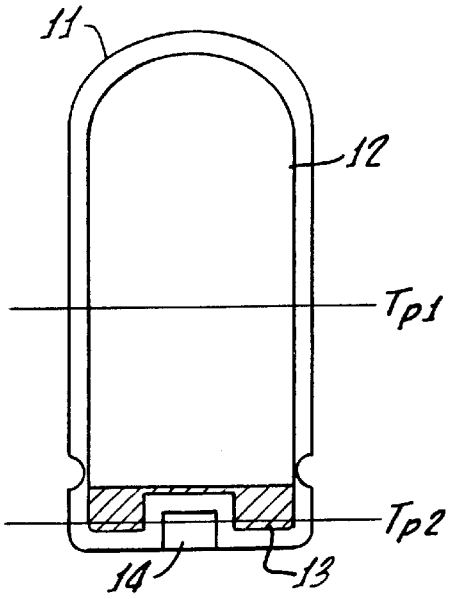
FIGS. 14–15 show further embodiments of the present invention.
Figure 15:
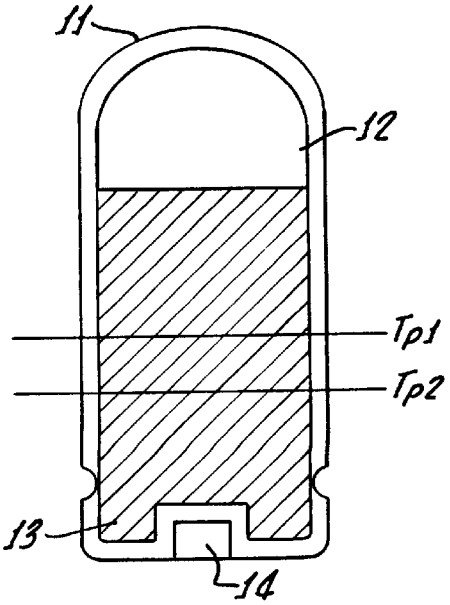

As will appear from FIGS. 14 and 15, the vaginal weight shown comprises a shell 11, which is divided into upper and lower parts. The shell 11 may be made of PPO or e.g. polyethylene. The shell forms a cavity 12 which is provided with a weight member 13 at its lower termination. The weight member 13 may e.g. be made of stainless steel. According to the invention, the weight member may e.g. be snapped, glued or screwed on, e.g. as a bayonet socket.

An advantage of this embodiment of the invention is furthermore that the weight member may be selected in a given size and be inserted separately, thereby making it possible to achieve a given lowering of the center of gravity. It is also possible to change a given weight, just as it is possible to adjust the associated center of gravity, as will appear from FIG. 14 compared with FIG. 15.

The weight member 13 or the shell 11 additionally has an anchorage 14 which may be used for securing a string or the like to retrieve the weight from its position of use.

FIG. 15 shows a cross section corresponding to the embodiment of the invention shown in FIG. 14, in which the weight member 13 occupies a larger part of the cavity 12, so that the downward displacement of the center of gravity is not as great as in the embodiment shown in FIG. 14. Moreover, the total weight has been increased.

Finally, it should be noted that according to the invention, it is possible to make a very flexible kit or set of weight components permitting the design of a vaginal weight that may be adapted to the special anatomical conditions which apply to a specific patient.

Such a kit may e.g. be formed by a set of different geometrical shapes having exchangeable rough surfaces in the form of bands which may be snapped on to the weight, or the like, as well as exchangeable weight members.

Such a kit enables a practitioner to make a controlled optimum adaptation of one or more vaginal weights, and also allows current adjustment of weight as well as surface in step with the development that occurs in the course of the treatment.

With reference again to FIGS. 3, 14, 15 and 19, the center of gravity of the weight member (Tp2) or the total center of gravity of the weight members inside the vaginal weight is below the center of gravity (Tp1) of the vaginal weight without weight member or members and said lower termination of the vaginal weight comprises a substantially plane end face, a particularly advantageous embodiment of the invention is achieved, since directional stability in use is obtained.

Thus, it is ensured that the vaginal weight is stabilized toward a vertical position (shown in solid line in FIG. 19) when positioned inside the vagina, which improves the effect of the exercise. In a standing position, the vagina has an inclination of 40° with respect to the supporting plane, and, in contrast to the known weights, the weight of the invention will follow the 40° inclination, which means that the relevant muscles are exercised.

According to the invention, it is also ensured that vaginal weight will not assume a transverse position (shown in dashed lines in FIG. 19) if the weight is placed too high and/or if the pelvic floor is very weak. Thereby, the vaginal weight rests on the musculature when placed in the vagina. The substantially flat surface combined with the feature that the center of gravity of weight members is placed below the center of gravity of the vaginal weight 1 without weight members also improves the self-aligning effect of the vaginal weight.

It will be appreciated that the weight member may advantageously form part of the shell, so that it may be retrieved, inserted and adjusted in a single operation.

According to the invention, when used correctly, even physical activities will not cause the weight to slide higher up or out.

When the center of gravity of the weight member or the total center of gravity of the weight members inside the vaginal weight is at least 10%, preferably 25 to 50% below the center of gravity of the vaginal weight without weight member or members, a particularly advantageous embodiment of the invention is achieved, as the vaginal weight has a strong stabilizing arm which is lengthened when the center of gravity of the weight member or members is moved further down relatively to the center of gravity of the vaginal weight.

When the mass of the vaginal weight is inversely proportional to the diameter of the vaginal weight, a particularly advantageous embodiment of the invention is obtained, it being ensured that a vaginal weight may be used correctly, with a view to adapting the use of the individual vaginal weights to the actual physical conditions of a user.

This applied especially to women who suffer from a particularly severe degree of incontinence, since vaginal weights may thus be formed with a large diameter, but with a relatively small total mass, thereby enabling the user to retain the vaginal weight in use. This means that an actual therapeutic effect may be obtained in the use of a vaginal weight according to the invention, even when the user suffers from a particularly severe degree of incontinence.

Thus, it is possible to use a weight according to the invention in a physiologically extremely advantageous manner, since the use of the largest vaginal weight takes place in the case where the levator gap of the woman is so wide that other diameters merely slip out, without the weight being so great that this in itself causes the weight to slip out.

When the vaginal weight has upper and lower parts, said upper part being formed with a larger diameter than the lower part, the intended position of the vaginal weight in the vagina will be maintained safely.

When the upper part constitutes about ⅔ of the total length of the weight, and preferably the upper part has a fine-structured facilitation surface and the lower part has a coarse-structured facilitation surface, a particularly advantageous embodiment of a vaginal weight according to the invention is achieved.

When the weight member forms part of the total surface of the vaginal weight, an embodiment of a vaginal weight according to the invention is achieved which will be simple to manufacture.

When the side face of the vaginal weight has generatrices which are substantially parallel with the longitudinal axis of the vaginal weight, and the side faces form the lower termination of the vaginal weight via a rounded curvature having a radius of curvature which is smaller than the radius of the vaginal weight, a particularly advantageous embodiment of the invention is achieved, as the lower termination of the weight may be formed with an edge which is rounded, thereby allowing the weight to maintain its position in a particularly effective manner.

When the radius of curvature is smaller than half the radius of the vaginal weight, preferably smaller than 20% of the radius of the vaginal weight, a particularly advantageous embodiment is achieved, as the lower termination forms a rounded edge, thereby achieving a weight whose outer shape does not cause or induce displacement of the weight from its position of use.

This is illustrated in FIGS. 16, 17 and 18. A prior art device 150 is shown in FIG. 16 in relation to surrounding muscle tissue 152. It should be readily apparent that because of the tapered outside surface 154 of the device 150, constriction of the muscle tissue 152 (shown by arrows 156) will cause movement of the device 150 in the direction of arrow 158. Thus, the device 150 does not provide a stable system for facilitation.

In contrast, weights 160, 130 in accordance with the present invention, as shown in FIGS. 17 and 18, a flat portion 162, with rounded edge 164, provides a user sensed vaginal resistance during outward movement of the weight 160 as provided by a string 166.

Figure 19:
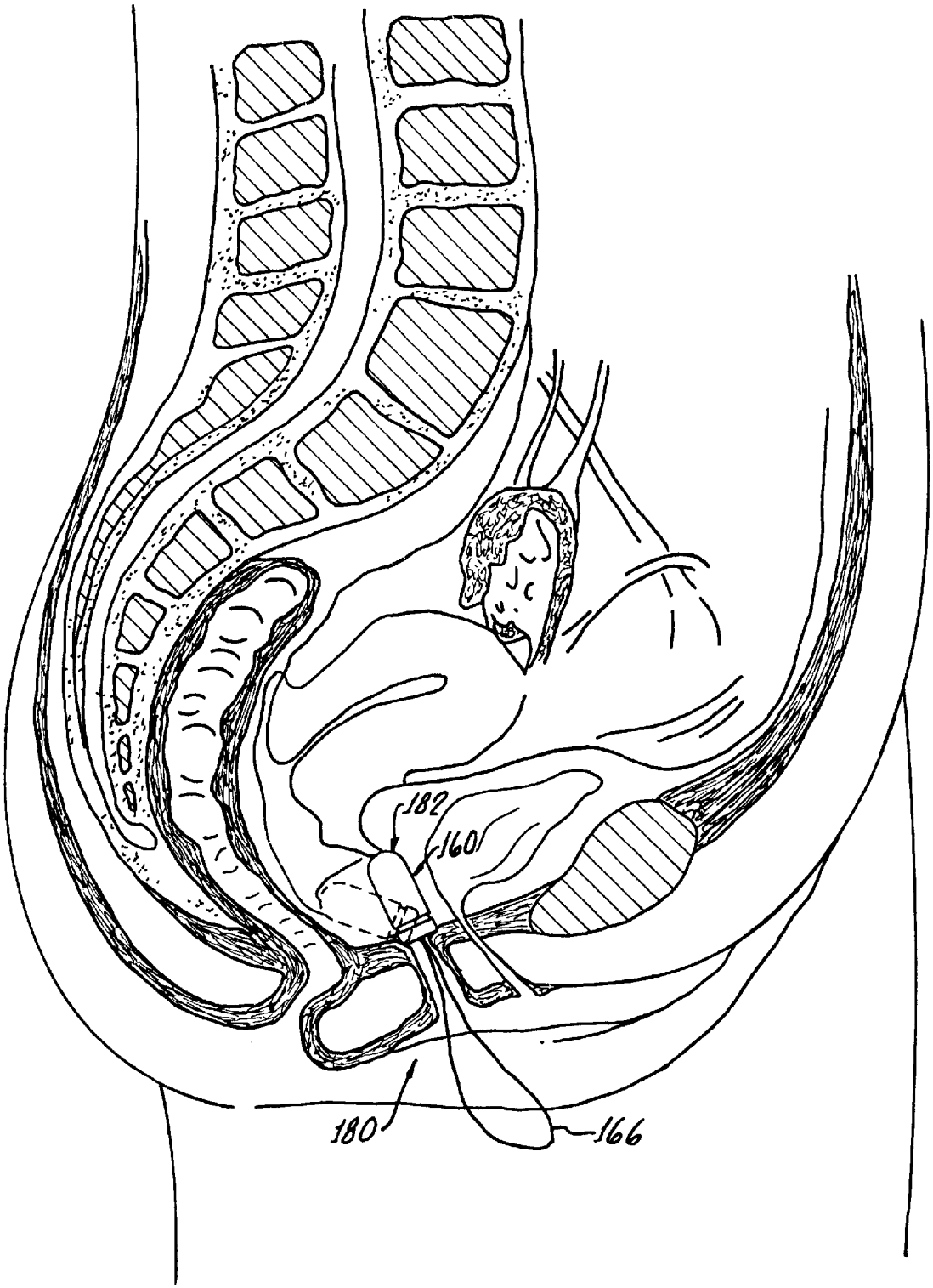
FIG. 19 is a diagram illustrating the methods of the present invention.

It should be appreciated that in a standing position, as shown in FIG. 19, gravity also provides an outward movement which can be sensed by the user.

When in place, as illustrated in FIG. 17, constriction of the muscle tissue 152 (again shown by the arrow 156) does not cause movement of the weight 160. Accordingly, facilitation can be effectively practiced.

When the vaginal weight 160 is conical at the top, an advantageous embodiment of the invention is achieved, as the weight relative to its shape is easy to insert into the vagina.

Importantly, as shown in FIG. 18, a larger upper portion 129 further stabilizes the weight 130 by resting on the tissue 152 and adds further resistance to downward movement of the weight 130 from its ideal position as shown in FIG. 18.

When the vaginal weight 160 is formed wholly or partially with a rough surface 170, the vaginal weight causes the facilitation provided by the vaginal weight 160 to be increased, since surface roughness 170, when touching muscular tissue 152, provides or enhances the afferent input when the muscle tone apparatus of the muscle is affected.

Thus, it is possible according to the invention to perform improved facilitation of the muscular tissue for contraction via a sensory input from the contact of the weight with the muscular tissue 152.

It will be appreciated that the roughness provided on the surface of the vaginal weight 160 must not be capable of damaging the mucosa of the vagina, just as it must be ensured that the roughness itself cannot keep the vaginal weight positioned as the therapeutic effect is then lost.

Optionally, the rough surface may be formed by a rubber coating on the surface of the weight 160.

When the rough surface of the vaginal weight is formed wholly or partially by an assembly of discrete embossings and/or projections in the surface, an advantageous embodiment of the invention is achieved, as the actual finishing of a surface of a vaginal weight may be performed in a simple manner such that the facilitation provided by the vaginal weight in use may be enhanced, while maintaining an advantageous shape with respect to cleaning and hygiene.

When the weight 160 is formed with e.g. grooves 172, the surface roughness of the weight will thus be achieved by means of discrete "macroscopic" formations in the surface, and these may therefore be subjected to thorough and sufficient cleaning without the use of a special apparatus.

It must be ensured when providing this surface structure that the surface structure is suitably small and/or rounded, so that the weight does not damage the mucosa of the vagina in use.

The assembly or assemblies of discrete embossings and/or projections in the surface comprise e.g. small grooves, small studs or small bosses, which per se may have a microscopic roughness.

When the rough surface is formed preferably on the side walls of the vaginal weight, while the upper termination and the lower termination of the vaginal weight are formed with a smooth surface, an advantageous embodiment of the invention is achieved, as facilitation according to the invention is obtained in the position of use, just as insertion and retrieval of the vaginal weight are not obstructed by the rough surface.

It should be stressed in this context that, in several aspects, the invention is precisely intended to avoid retention of the vaginal weight by the rough surface itself in a given position in use.

When the pattern is formed by small bosses in the surface of the vaginal weight, a particularly advantageous embodiment of the invention is achieved.

When the weight is formed with bosses, the surface roughness of the weight will thus be achieved by means of discrete "macroscopic" formations in the surface, and these may therefore be subjected to thorough and sufficient cleaning without the use of special apparatus.

It is also possible to control the degree of roughness in a simple manner on the basis of at least one of the following parameters: boss height, boss density, boss pattern and boss roundness with respect to the surface of the vaginal weight.

When the lower termination comprises a substantially plane end face, a particularly advantageous embodiment is achieved, as the self-aligning effect, in combination with the plane end face, provides a physiologically advantageous position and stimulation by stationary positioning in the vagina.

When the mass of the individual vaginal weights is inversely proportional to their diameter, it is possible to design a set of weights which may be used in practice by a clinician for the treatment of women having different anatomical structures and degrees of incontinence. In particular, it is possible to design the set so that there will be a weight of suitable mass and diameter corresponding to an optimum parameter of treatment.

Finally, it should be noted that according to the invention, it is possible to make a system, or kit or set of weight components, permitting the design of a selected vaginal weight that may be adapted to the special anatomical conditions which apply to a specific patient as hereinabove discussed.

Additionally, it is an advantage that such a set according to the invention may be formed by a set of different geometrical shapes having exchangeable rough surfaces in the form of bands, elements that may be snapped on to the weight, or the like, as well as exchangeable weight members.

Such a set thus enables a practitioner to make a controlled optimum adaptation of one or more vaginal weights, and also enables current adjustment of weight as well as surface in step with the development that takes place in the course of the treatment.

With reference now to FIG. 19, there is shown in diagram form a weight 160 in accordance with the present invention utilized in the method in accordance with the present invention for exercising and examining the striated musculature of the vagina. When utilizing the system in accordance with the present invention which provides for a plurality of weights, only one weight 160 being shown in FIG. 19, a selected weight having a diameter approximately equal to a levator gap of the user is selected.

It should be appreciated that the diameter of the weight selected is, as hereinabove discussed, a user dependent and a selected weight should be of such diameter to enable the user to maintain, or hold the selected weight, in a facilitation position.

After selection, the weight 160, as shown in FIG. 19, is inserted into the user's vagina 180 with a rounded end means 182 facilitating the insertion. Thereafter, another end of the selected weight 160 is withdrawn, preferably by the string 166 until a vaginal resistance is sensed by the user in order to position the selected weight 160 in the user's vagina 180 to effect the facilitation.

Thereafter, selected weight 160 is held in the facilitation position without user movement for a first period of time by squeezing the pelvic floor muscles. The first period of time may vary depending upon circumstances, but initially such duration is expected to be about 20 seconds. Thereafter the selected weight 160 is removed from the vagina.

The hereinabove recited procedure is repeated with rest periods of a second duration of being approximately 20 seconds.

The entire procedure is continued for a total exercise period which should not exceed about 5 minutes. Exercise efforts beyond this period of time may be counterproductive. The procedure is repeated in which the weight is held in place for 30 seconds and rested for 30 seconds. Once the strength training exercise, initially with the feet together and then with the feet apart, has been mastered, the procedure should be continued on a daily basis.

Endurance training exercises can also be performed. For example, perform any two or three of the following endurance training exercises each day and alternate the exercises to strengthen muscles in different positions/situations. It is also preferable to keep a daily log to chart exercise progress. The exercises are as follows:

STANDARD EXERCISES

A. Walk at a normal gait for one minute.
B. Jog in place for 30 seconds (increase time to one minute as you progress).
C. Hop on your left foot five times. Hop on your right foot five times. Hop on both fee together five times.
D. Do ten deep knee bends.
E. Alternate lifting your left and right knee waist-high, five times on each leg.

ADVANCED EXERCISE

F. Perform ten jumping jacks.

LIFESTYLE EXERCISES

G. Simulate lifting a heavy object five times.
H. Cough five times.
I. Talk and laugh while holding a contraction for 30 seconds.

Although there has been hereinabove described a vaginal weight, system and method, in accordance with the present invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A vaginal weight for insertion into a vagina for exercising and examining the striated musculature, the weight comprising:

a tubular portion;

a rounded end, disposed at one end of said tubular portion, for enabling smooth insertion into the vagina; and means, disposed at another end of said tubular portion, for providing a user sensed vaginal resistance during outward movement of the weight from the vagina, said means comprising a flat end surface disposed at a generally perpendicular angel with a tubular portion longitudinal axis, said flat end surface being joined with an outside surface of said tubular portion by a rounded corner.

2. The weight according to claim 1 wherein the means disposed at another end of said tubular portion further comprises a rough surface disposed on the tubular portion outside surface.

3. The weight according to claim 1 further comprising means for positioning said weight in the vagina for enhanced facilitation.

4. The weight according to claim 3 wherein the means for positioning said weight comprises a string attached to the another end of said tubular portion.

5. The weight according to claim 4 wherein the means for positioning said weight further comprises a mass disposed within said weight at a position causing a center of gravity of the weight to be closer to the another end than the one end of said tubular portion.

6. The weight according to claim 3 wherein the means for positioning said weight in the vagina comprises a mass disposed within said weight at a position causing a center of gravity of the weight to be closer to the another end than the one end of said tubular portion.

7. A vaginal weight for insertion into a vagina for exercising and examining the striated musculature, the weight comprising:

a tubular portion;

a rounded end, disposed at one end of said tubular portion, for enabling smooth insertion into the vagina; and means, disposed at another end of said tubular portion, for providing a user sensed vaginal resistance during outward movement of the weight from the vagina, said means comprising a rough surface disposed on a tubular portion outside surface adjacent the another end.

8. The weight according to claim 7 wherein said rough surface comprises an assembly of discrete optionally exchangeable embossings projecting from the tubular portion outside surface.

9. A vaginal weight for insertion into a vagina for exercising and examining the striated musculature, the weight comprising:

a tubular portion, and a rounded end, disposed at one end of said tubular portion, for enabling smooth insertion into the vagina; and means, disposed at another end of said tubular portion, for providing a user sensed vaginal resistance during outward movement of the weight from the vagina, said tubular portion including an upper part adjacent the rounded end and a lower part adjacent another end said upper part having a larger diameter than said lower part.

10. A vaginal weight system for exercising and examining the striated musculature, said vaginal weight system comprising:

a plurality of vaginal weights for insertion into a vagina, each vaginal weight being of different heaviness and diameter, each vaginal weight comprising:

a tubular portion;

a rounded end disposed at one end of said tubular portion, for enabling smooth insertion into the vagina; and means, disposed at another end of said tubular portion, for providing a user sensed vaginal resistance during outward movement of the weight from the vagina, said means comprising a flat end surface disposed at a generally perpendicular angle with a tubular portion longitudinal axis, said flat end surface being joined with an outside surface of said tubular portion by a rounded corner.

11. The system according to claim 10 wherein the means disposed at another end of said tubular portion of each weight further comprises a rough surface disposed on the tubular portion outside surface.

12. The system according to claim 10 wherein each weight further comprising means for positioning each weight in the vagina for enhanced facilitation.

13. The system according to claim 12 wherein the means for positioning each weight comprises a string attached to the another end of said tubular portion.

14. The system according to claim 13 wherein the means for positioning each weight further comprises a mass disposed within said weight at a position causing a center of gravity of the weight to be closer to the another end than the one end of said tubular portion.

15. The weight according to claim 13 wherein the heaviness of each weight is inversely proportional to the diameter of each weight.

16. The system according to claim 12 wherein the means for positioning each weight in the vagina comprises a mass disposed within said weight at a position causing a center of gravity of the weight to be closer to the another end than the one end of said tubular portion.

17. A vaginal weight system for exercising and examining the striated musculature, said vaginal weight system comprising:

a plurality of vaginal weights for insertion into a vagina, each vaginal weight being of different heaviness and diameter, each vaginal weight comprising:

a tubular portion;

a rounded end, disposed at one end of said tubular portion, for enabling smooth insertion into the vagina; and means, disposed at another end of said tubular portion, for providing a user sensed vaginal resistance during outward movement of the weight from the vagina, said means comprising a rough surface disposed on a tubular portion outside surface adjacent the another end.

18. The weight according to claim 17 wherein said rough surface of each weight comprises an assembly of discrete optionally exchangeable embossings projecting from the tubular portion outside surface.

19. A vaginal weight system for exercising and examining the striated musculature, said vaginal weight system comprising:

a plurality of vaginal weights for insertion into a vagina, each vaginal weight being of different heaviness and diameter, each vaginal weight comprising:

a tubular portion;

a rounded end disposed at one end of said tubular portion, for enabling smooth insertion into the vagina; and means, disposed at another end of said tubular portion, for providing a user sensed vaginal resistance during outward movement of the weight from the vagina;

said tubular portion of each weight including an upper part adjacent the rounded end and a lower part adjacent the another end, said upper part having a larger diameter than said lower part.

* * * * *